US006626775B2

(12) United States Patent
Tiitola

(10) Patent No.: US 6,626,775 B2
(45) Date of Patent: Sep. 30, 2003

(54) METHOD OF MANUFACTURING BLADE OF HOCKEY STICK OR THE LIKE, AND BLADE OF STICK AND BLADE CORE

(75) Inventor: Antti-Jussi Tiitola, Padasjoki (FI)

(73) Assignee: Montreal Sports Oy, Padasjoki (FI)

( * ) Notice: Subject to any disclaimer, the term of this patent is extended or adjusted under 35 U.S.C. 154(b) by 0 days.

(21) Appl. No.: 09/727,073

(22) Filed: Dec. 1, 2000

(65) Prior Publication Data

US 2001/0041633 A1 Nov. 15, 2001

(51) Int. Cl.[7] ..... A63B 59/14
(52) U.S. Cl. ..... 473/563; 473/562
(58) Field of Search ..... 473/562, 563, 473/342

(56) References Cited

U.S. PATENT DOCUMENTS

| | | | | | |
|---|---|---|---|---|---|
| 4,059,269 | A | | 11/1977 | Tiitola | 273/67 |
| 4,124,208 | A | * | 11/1978 | Burns | 473/562 |
| 4,358,113 | A | | 11/1982 | McKinnon et al. | 273/67 |
| 4,488,721 | A | * | 12/1984 | Franck et al. | 473/563 |
| 5,425,535 | A | * | 6/1995 | Gee | 473/300 |
| 5,558,326 | A | * | 9/1996 | Adamson et al. | 473/563 |
| 5,976,040 | A | * | 11/1999 | Liu | 473/563 |
| 6,019,691 | A | * | 2/2000 | Hilborn | 473/563 |
| 6,062,996 | A | * | 5/2000 | Quigley et al. | 473/563 |
| 6,213,903 | B1 | * | 4/2001 | Ford | 473/563 |

FOREIGN PATENT DOCUMENTS

| | | |
|---|---|---|
| EP | 648517 | 4/1995 |
| FI | 2977/69 | 10/1969 |
| FI | 2978/69 | 10/1969 |
| WO | 97/33660 | 3/1997 |

* cited by examiner

*Primary Examiner*—Mark S. Graham
(74) *Attorney, Agent, or Firm*—Sughrue Mion, PLLC

(57) ABSTRACT

A method of manufacturing a blade of a hockey stick or the like, a blade and a blade core used in the blade. The blade core is manufactured of a plastic material, recesses for arranging a strengthening layer being provided in vertical sides thereof. According to a preferred embodiment of the invention, the sides of the blade core are provided with two recesses within each other. Furthermore, a reinforcing element cut off from a wooden plate can be used as an inner strengthening layer of the blade core.

10 Claims, 7 Drawing Sheets

METHOD OF MANUFACTURING BLADE OF HOCKEY STICK OR THE LIKE, AND BLADE OF STICK AND BLADE CORE

BACKGROUND OF THE INVENTION

The invention relates to a method of manufacturing a blade of a hockey stick or the like, in which method strengthening layers are arranged in vertical sides of a core of the blade manufactured of a wear-resistant plastic material such that at least at a lower edge of the blade, the blade core extends farther than the strengthening layers and forms a wear-resistant border for the edge.

The invention further relates to a blade of a hockey stick or the like, the blade comprising a core of the blade and strengthening layers arranged in vertical sides of the blade core, the blade core being made of a wear-resistant plastic material and at least at a lower edge of the blade, the blade core extending farther than the strengthening layers, whereby the lower edge of the blade is provided with a wear-resistant border.

The invention further relates to a blade core comprising vertical sides, a lower edge to be arranged against a playing surface and an upper edge opposite to the lower edge, a tip and a heel, the blade core being manufactured of a plastic material.

Conventionally, the blades of hockey sticks and bandy sticks or the like have been manufactured by gluing together several sheets of wood. In order to make the blades stronger, layers of fiber-reinforced plastic, e.g. fiberglass, have been combined with the wooden layers. Such a structure is lightweight but not durable enough in connection with slap shots in particular. Furthermore, the lower edge of the blade, i.e. the edge facing the playing surface, wears down, which may cause reinforcing fibers of the laminate layer at the lower edge of the blade to break down and the lamination to be torn, which means that the structure is substantially impaired. A game resembling ice-hockey is increasingly being played on roller-skates as well. The playing surface is then the floor of a sports center or even asphalt, in which case the stick should be substantially more wear-resistant than when playing on slippery ice in the conventional manner. Attempts have been made to improve the wear-resistance of the blade structure by replacing the wooden core with a blade core manufactured of a thermoplastic plastic material. Fiber-reinforced stiffening layers have been laminated in the side surfaces of such a core such that the plastic blade core at least at the lower edge of the blade extends farther than the laminate layers, thus forming a wear-resistant border. This blade structure disclosed in U.S. Pat. No. 4,059,269 has become known particularly for its high wear-resistance. Players, however, find the blade too heavy. Furthermore, some players are not satisfied with the playing characteristics of the blade because they feel the blade is insensitive when it comes to handling a puck.

BRIEF DESCRIPTION OF THE INVENTION

An object of the present invention is to provide a method enabling a simple way to manufacture blades of a stick. A further object is to provide a blade which has good mechanical properties with respect to its weight and which is easy to manufacture. A still further object is to provide a blade core which enables strong blades with good playing characteristics to be manufactured.

A method of the invention is characterized by using a premanufactured blade core, at least one side of the blade core being provided with a flat recess which is parallel with a surface of the side and which is at least approximately similar in length to the blade core, and embedding a structural layer in said recess to strengthen the blade.

Furthermore, a blade of a stick according to the invention is characterized in that at least one side of the blade core is provided with a flat recess parallel with a surface of the blade, and that at least one of strengthening layers in the side of the blade is arranged in said recess.

Further, a blade core of the invention is characterized in that at least one side of the blade core is provided with a flat recess for arranging a strengthening layer, the recess being parallel with a surface of the blade core.

The idea underlying the invention is that the inner part of the blade comprises a blade core manufactured of a wear-resistant plastic material, the blade core at least at the lower edge of the blade extending farther than the strengthening layers arranged in the sides of the blade core, thus forming a wear-resistant border. A side of the blade core is provided with a flat recess wherein at least one of the layers strengthening the structure of the blade is arranged. The recess is parallel with the surface of the side of the blade core, i.e. vertical, and at least approximately similar in length to the blade core.

The idea underlying a preferred embodiment of the invention is that at least one side of the blade core is provided with at least two recesses which narrow stepwise from the surface of the blade core towards the inner part thereof. The surface area of the strengthening structural layer arranged in an inner recess is thus smaller than the surface area of the layer arranged in an outer recess. If desired, all strengthening structural layers attached to the sides of the blade core may be embedded in the recesses of the blade core.

The idea underlying a second preferred embodiment of the invention is that wooden strengthening layers are arranged in the inner recesses while the outer recesses are provided with layers made of a fiber-reinforced plastic material.

The idea underlying a third embodiment of the invention is that the blade is assembled from premanufactured structural components, such as a blade core and reinforcing elements cut to correspond the shape of the recesses to be attached thereto.

An advantage of the invention is that the blade is simultaneously wear-resistant and rigid but still lightweight. This is enabled by the recesses provided in the blade core wherein the layers stiffening the blade structure are arranged. Particularly when wood, which is lighter than the material of the blade core, is used as the strengthening layer the weight decreases significantly. The volume of the recesses is then replaced by a lighter material, which results in good weight/rigidity ratio for the blade. Furthermore, at the edges, which are subjected to impacts and wear, the blade core manufactured of a wear-resistant plastic material extends farther than the rest of the components, thus forming a border to protect the blade structure. The playing characteristics, i.e. the feel for the puck, of the blade of the invention are also good. An important advantage is also that the blade structure is well suited for industrial mass production, which enables sticks to be manufactured at competitive prices. The blade is quick to assemble from premanufactured components and the assembly may be carried out even in one automated stage of operation.

BRIEF DESCRIPTION OF THE DRAWINGS

The invention will be described in closer detail in the accompanying drawings, in which.

In the figures, like reference numerals identify like elements. The figures have been simplified for the sake of clarity.

DETAILED DESCRIPTION OF THE INVENTION

Figure 1:
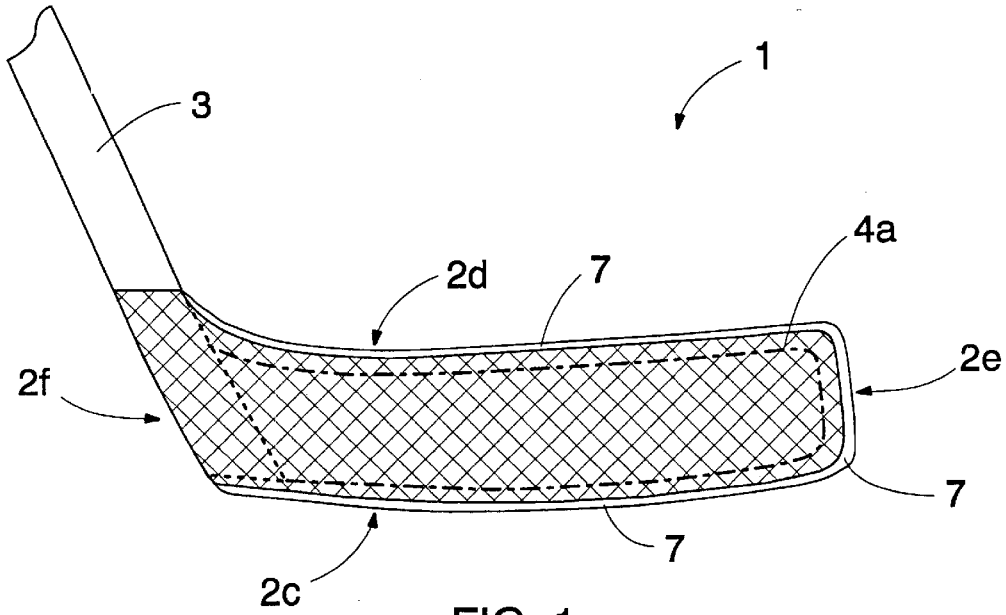
FIG. 1 is a schematic side view of a blade of a stick according to the invention.
Figure 2A:
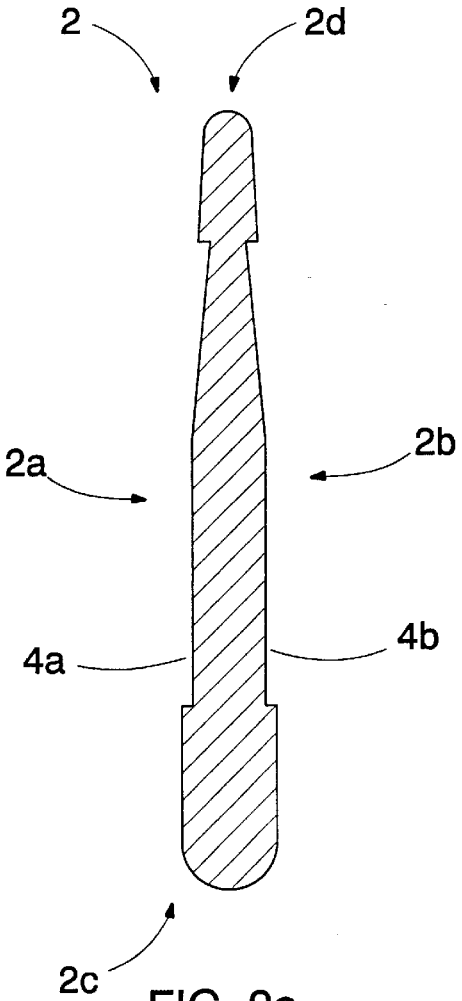
FIG. 2*a* is a schematic cross-sectional view of a blade core used in the stick of FIG. 1.
Figure 2B:
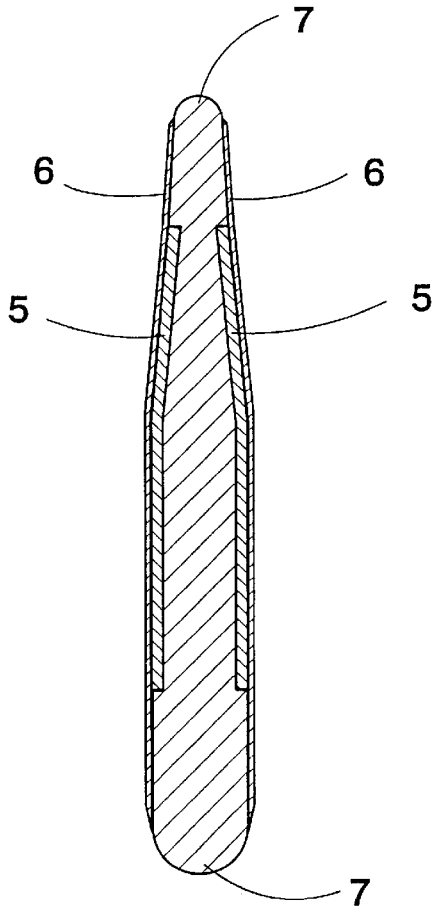
FIG. 2*b* is a cross-sectional view of an assembled blade.

FIG. 1 is a side view of a blade of the invention. It should immediately be noted that although the figures in the application and the description thereof only show blade structures of hockey sticks, it is obvious that the invention can also be applied to sticks used in bandy, rinkball, street hockey and the like. Furthermore, the invention can be applied both to the sticks used by goalies and other players. A blade core 2 manufactured of a thermoplastic plastic, such as ABS (Acrylonitrile Butadiene Styrene) plastic or polyethene, is used in the blade 1, a cross-sectional view of the blade core 2 being shown in FIG. 2*a*. The blade core 2 comprises vertical sides 2*a* and 2*b*, a lower edge 2*c* to be arranged against a playing surface, an upper edge 2*d* opposite the lower edge 2*c*, an edge 2*e* facing a tip of the blade, and further an edge 2*f* facing a shaft 3 of the stick. Recesses 4*a* and 4*b* are arranged in the sides 2*a* and 2*b* of the blade core in connection with the manufacture of the blade core. The edge of the recess 4*a* is indicated in a broken line in FIG. 1. An inner strengthening structural layer 5 is arranged in the recess, as shown by FIG. 2*b*. The strengthening layer is preferably made of wood, which is more rigid than the thermoplastic plastic used in the blade core being, however, lighter at the same time. When the part of the plastic material of the blade core corresponding with the recesses is then replaced e.g. by lightweight wood, the structure becomes not only stiffer but also lighter. The rigidity/weight ratio in wood is particularly good, and wood is also otherwise suitable for the structures of sticks. The inner reinforcement may, of course, also be made of any other suitable strengthening material, such as e.g. a fiber-reinforced plastic material or a piece cut off from some other sheet-like material. Further, in a manner known per se, a layer of a glass-fiber-reinforced plastic material is laminated as an outer layer 6 on the sides of the blade. Instead of glass fabric, also other suitable reinforcing fibers commonly used in the field, such as carbon and/or aramid fibers, may naturally be used in the outer strengthening layer. The fibers do not necessarily have to be woven fabric but they can also be e.g. braid, fiber-reinforced mat or the like. A plastic matrix used in the reinforcement can be epoxy resin, polyester resin or some such material suitable for the purpose. A necessary number of strengthening layers is laminated on top of each other and the characteristics of the blade can be adjusted by e.g. modifying the direction of the fibers in the layers and the order in which the layers are arranged on top of each other. The outer strengthening layer is formed such that it does not quite reach the upper and lower edges of the blade, in which case the blade core forms a wear- and impact-resistant border 7 at the upper and lower edges of the blade. It is preferable to form such a protecting border at the tip of the blade as well. The outer strengthening layer 6 is further beveled at its edges in the manner shown in FIG. 2*b*, whereby the risk of the strengthening layer being torn and damaged is smaller. The outer strengthening layer 6 preferably extends over the joint of the blade and the shaft 3, whereby the shaft and the blade are joined together by utilizing the outer strengthening layer 6. The outer strengthening layer may further extend a necessary distance upwards the shaft of the stick, which makes the joint between the blade and the shaft as well as the lower part of the shaft sturdier. The outer strengthening layer is preferably a uniform piece of reinforced fabric cut to a specified shape, extending from the first side of the blade over the heel all the way to the second side of the blade. Correspondingly, the inner strengthening layers can be cut in advance to reinforcing elements with a specified size, in which case, depending on the structure and the materials, it is simple to glue, weld or laminate them into the recesses of the blade core in connection with the assembly of the blade. Such premanufactured reinforcing elements can be cut off e.g. from a sheet of wood having a suitable thickness. The cutting can be carried out accurately and efficiently by die cutting, e.g. in a press by stamping or water jet cutting. The thickness of the reinforcing element may be constant from the tip to the heel of the blade, and similarly from the upper edge to the lower edge of the blade, since the shape of the blade is mainly determined by the blade core. This makes the structural components substantially easier to manufacture. In connection with the manufacture, a relatively thin reinforcing element may, however, easily be bent into its place in the recess regardless of the curvature of the blade or the profile of the recess. For example, there is a bend in the middle section of the recess shown in FIG. 2*a*. In an assembly press the wooden plate bends according to the shape of the recess. The recess does thus not necessarily have to be rectangular as seen from the tip of the blade but if necessary, it may be given e.g. a slightly curved shape when found relevant to the strength, rigidity or characteristics in use of the blade.

Figure 3:
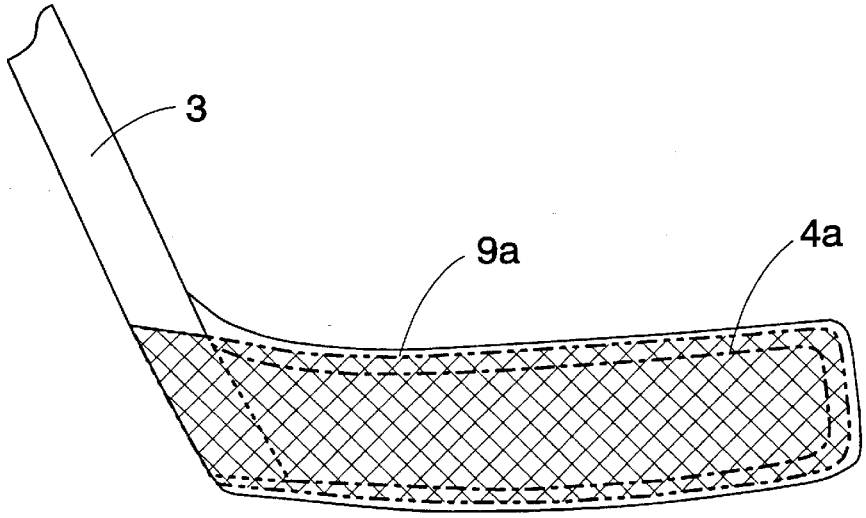
FIG. 3 is a schematic side view of a second blade of the invention.

FIG. 3 shows a second blade structure of the invention which is similar to the one disclosed above except that both sides 2*a* and 2*b* of the blade core are now provided with two recesses within each other. In a vertical direction of the blade, the inner recess 4*a*, 4*b* is smaller than the outer recess 9*a*, 9*b*, whereby the surface area of the recesses decreases stepwise from the surface of the blade towards the inner part thereof. The inner recess is usually deeper than the outer recess. The depth of the inner recess is preferably 1 to 1.5 mm and the depth of the outer recess is preferably 0.5 mm. The depths may also be equal, depending on the reinforcing elements used. Furthermore, in a longitudinal direction of the blade the recesses may be equal in length, or the outer recess preferably extends farther towards the tip of the blade, as in FIG. 3. FIG. 4*b* shows the strengthening layers embedded in the blade core. The inner reinforcing element 5 is preferably a piece cut off from plate-like sheet of wood to a shape corresponding with that of a side profile of the inner recess, the surfaces of the piece being spread with epoxy resin or some such gluing agent. The outer reinforcing element 6, in turn, is a piece cut to shape from glass fiber or some such fabric, or several such fiber reinforcement pieces laminated on top of each other and impregnated with epoxy resin or the like. Premanufactured, cut-to-size laminate structures made of a suitable matrix plastic and reinforcing fiber which are glued together and to the blade core by using a suitable gluing agent can also be used both as the inner and the outer reinforcing elements. If the blade core and the gluing and adhesive agents are a thermoplastic plastic material, the attachment can also be carried out by melting.

Figure 4A:
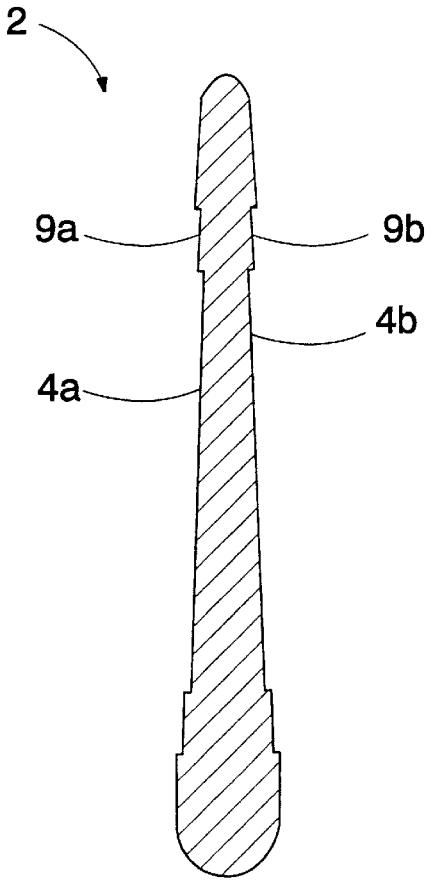
FIG. 4*a* is a schematic cross-sectional view of a blade core used in the blade of FIG. 3.
Figure 4B:
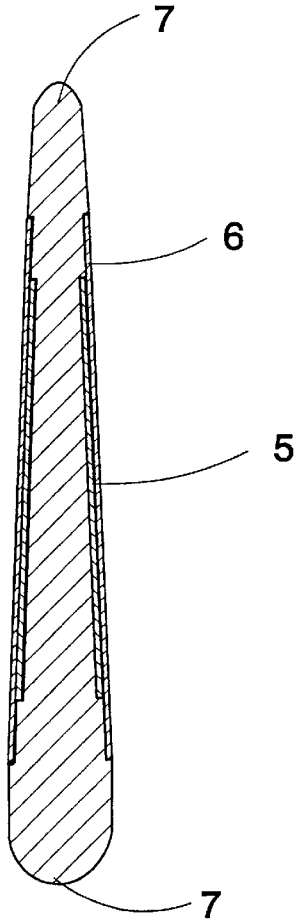
FIG. 4*b* is a cross-sectional view of an assembled blade.
Figure 5:
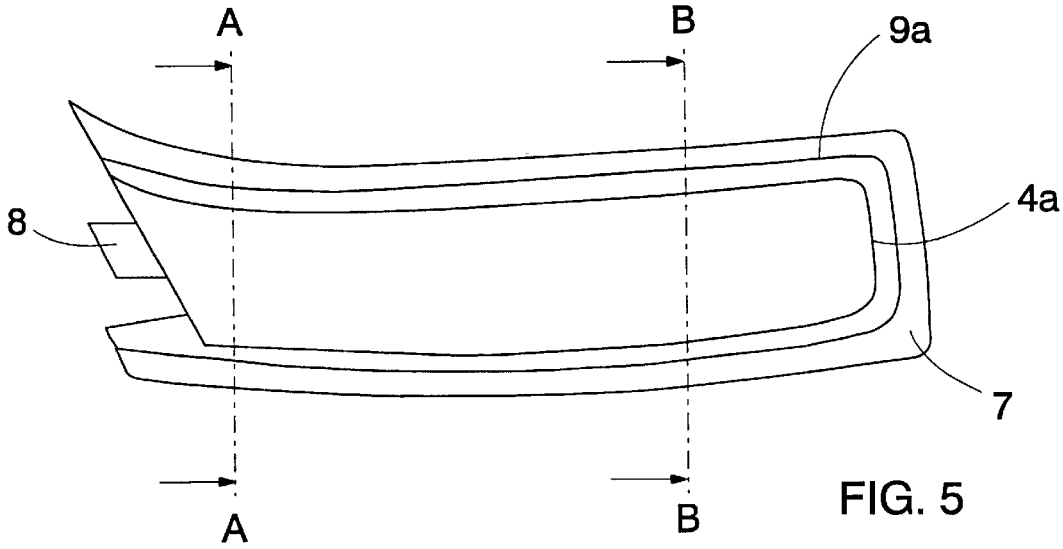
FIG. 5 is a side view of the blade core of the invention.

FIG. 5 is a side view of the blade core used in the blade structure according to FIGS. 3 to 4*b*. A preform of the blade may be much larger in its outer dimensions than the final blade, which enables the preform to be formed e.g. by milling into blades with various profiles. Furthermore, the edges of the blade may be rounded. In order to enable the stick to be customized player-specifically by shaping the border, the borders may be intentionally overdimensioned. The blade core is preferably manufactured by injection molding, which gives a precisely dimensioned product. Furthermore, injection molding is well suited for mass production, which means that manufacturing costs remain low. An injection-molded blade core mainly defines the dimensions and shape of the blade. The blade is given its final curvature in connection with the assembly pressing wherein the strengthening layers and the shaft of the stick are attached to the blade preform. The blade core may further be provided with a suitable space for the shaft or guiding parts 8 which alleviate the positioning of the shaft and the blade with respect to each other but which do not substantially affect the strength of the blade.

Figure 6A:
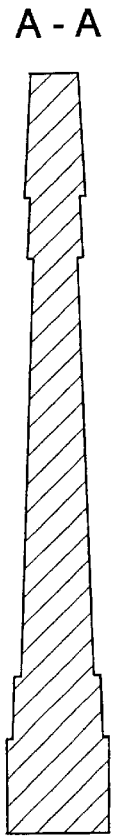
FIGS. 6*a* and 6*b* are cross-sectional views of the blade core taken at different points thereof.
Figure 6B:
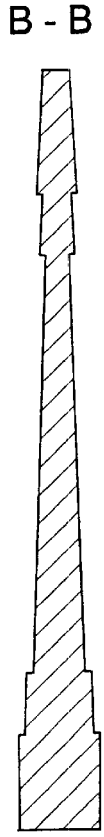

FIG. 6*a* is a cross-sectional view of the blade core as seen at the heel of the blade and FIG. 6*b* as seen at the tip of the blade. As can be seen from the figures, the profile of the blade core is thicker at the heel of the blade than at the tip thereof. This is evident since due to the length of the blade, the heel part receives greater impacts than the tip of the blade where the load mainly consists of shear stress. Furthermore, owing to the load caused by the puck and the playing surface, the cross section of the blade is greater at the lower edge than at the upper edge of the blade.

Figure 7A:
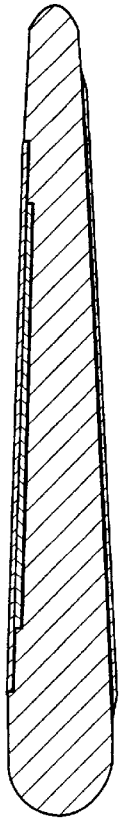
FIGS. 7*a* to 7*d* show further cross-sectional views of the blade structures according to the idea underlying the invention.
Figure 7B:
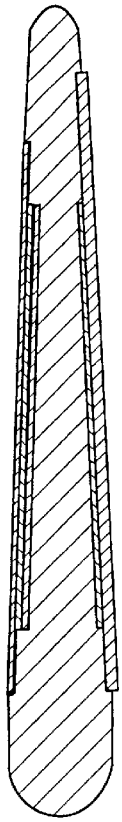
Figure 7C:
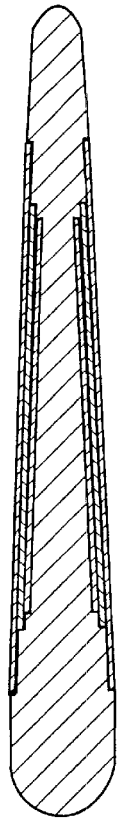
Figure 7D:
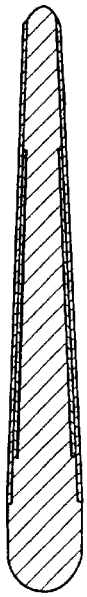

FIG. 7*a* shows an asymmetrical blade core wherein only the left side of the blade is provided with recesses for the strengthening layers while the right side is provided with a fiber-reinforced plastic layer laminated on the surface of the blade core with no recess. Sometimes such a structure may be functional. FIG. 7*b* shows a second blade structure asymmetrical with respect to its central axis and a blade core. Now, the inner recess of the left side is deeper than a corresponding inner recess in the right side, whereby the left side comprises two strengthening layers arranged within the inner recess. Depending on the depth of the recesses and the thickness of the strengthening layers, a single recess may thus comprise several strengthening layers on top of each other; in addition, the dimensioning of the recesses may vary at different sides of the blade core, if necessary. Furthermore, the recesses at the same side of the blade core may be located asymmetrically with respect to each other, as the right hand recesses in FIG. 7*b*. Furthermore, FIG. 7*c* shows three recesses within each other, but depending on thickness of the strengthening layers and other dimensioning and structure of the blade, there can even be more recesses. FIG. 7*d* further shows a blade of the invention wherein the outer recess extends all the way to the upper part of the blade. If necessary, both recesses may extend to the upper part. Such a solution can be utilized when no protecting border is needed at the upper edge of the blade.

Figure 8A:
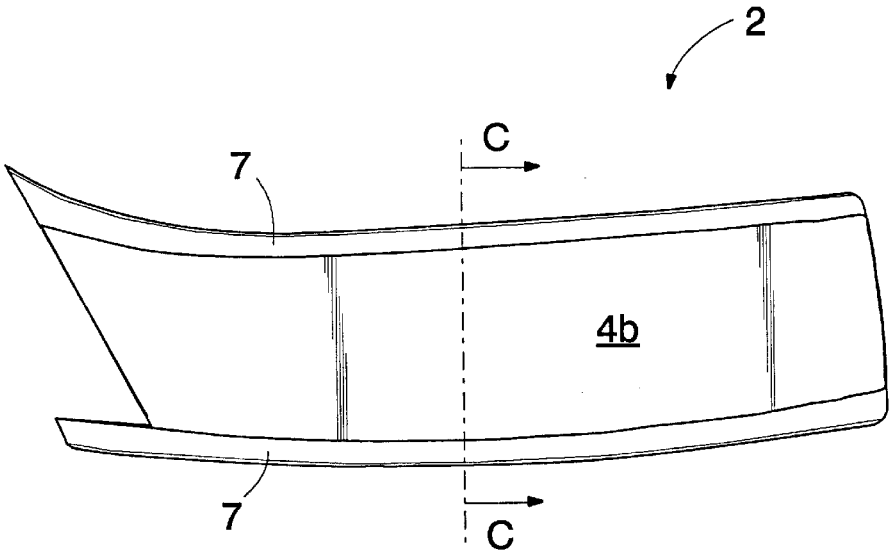
FIG. 8*a* is a schematic side view of a blade structure of the invention.
Figure 8B:
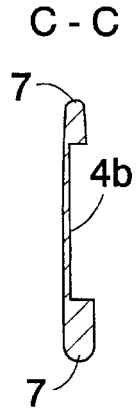
FIG. 8*b* is a cross-sectional view of the same taken along line C—C.

FIGS. 8*a* and 8*b* show a blade core 2 which is asymmetrical with respect to its central axis. One side of the blade core is provided with a flat recess 4*b* extending from the tip of the core to the heel thereof. The recess is formed in the "backhand", i.e. the convex, side of the blade. The blade is curved later during the manufacturing process. The lower edge as well as the upper edge of the blade core 2 are provided with protecting borders 7 to protect the blade against impacts and wear. The blade core is manufactured in advance, preferably of a thermoplastic plastic material, such as ABS plastic. The blade core is simple and cost-efficient to manufacture by injection molding.

Figure 9A:
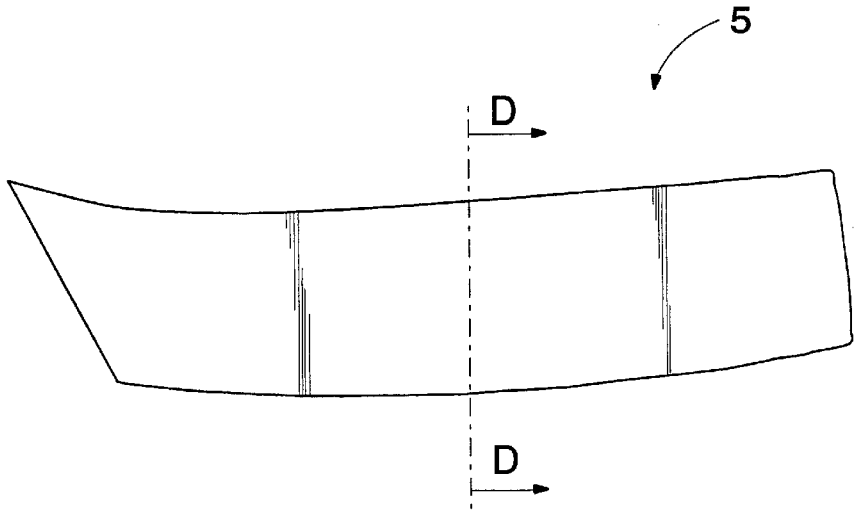
FIG. 9*a* is a schematic side view of a stiffening element which can be arranged in the blade core of FIG. 8*a*.
Figure 9B:
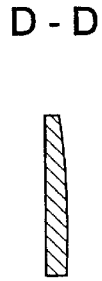
FIG. 9*b* is a cross-sectional view of the stiffening element taken along line D—D.

FIGS. 9*a* and 9*b* show an elongated, flat stiffening element 5 to be arranged in a recess of the blade core of FIGS. 8*a* and 8*b*. The stiffening element is preferably manufactured of a foamed plastic material, such as polyurethane. The stiffening element may be manufactured e.g. by mold casting. The density of the stiffening element is less than $0.5*10^3$ kg/m$^3$, preferably less than $0.3*10^3$ kg/m$^3$, whereas the density of the blade core 2 is about $1.1*10^3$ kg/m$^3$. In the blade structure, the light stiffening element replaces the denser blade core material, thus enabling a lightweight blade structure. The dimensions and shape of the stiffening element have been arranged to substantially correspond with the recess of the blade core.

Figure 10A:
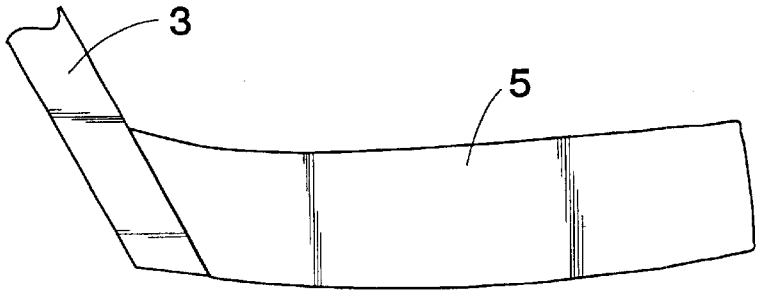
FIGS. 10*a* to 10*c* are schematic side views of stages of the manufacture of a blade according to a preferred embodiment of the invention.
Figure 10B:
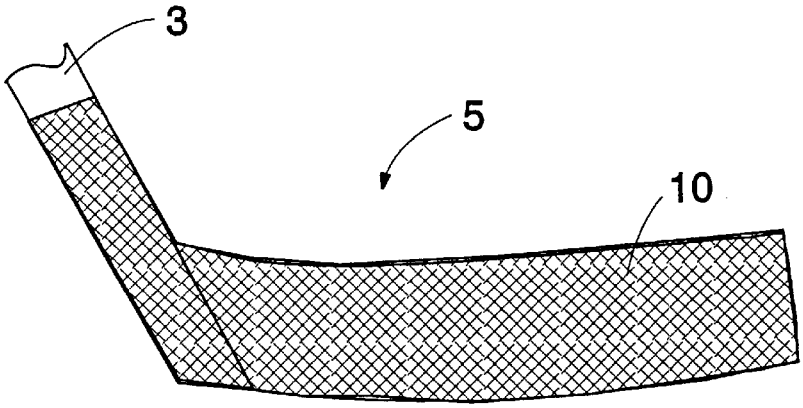
Figure 10C:
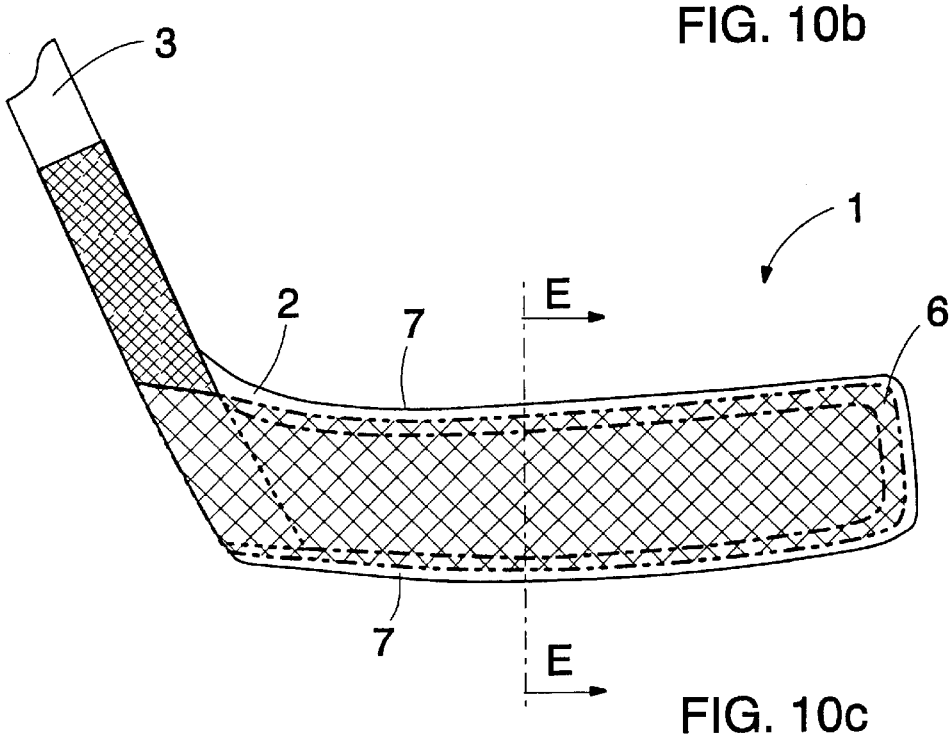

FIGS. 10*a* to 10*c* show the stages of manufacture of a blade structure to be assembled from the components according to FIGS. 8*a* to 9*b*. According to FIG. 10*a*, the stiffening element 5 is attached to the thinned lower end of the shaft 3 in the first stage of the assembly. The attachment is preferably carried out by utilizing a hot-melt adhesive but also other attaching methods may be applied as necessary. FIG. 10*b* shows the second stage of the assembly wherein a sock-like reinforcing fabric 10 is slipped on the stiffening element 5. The reinforcing fabric is also extended around the lower part of the shaft 3, whereby the uniform strengthening layer binds the shaft and the stiffening element together. The reinforcing fabric mainly comprises glass fibers but it may also comprise a necessary amount of carbon and/or aramid fibers in order to achieve the desired rigidity characteristics. Instead of the sock-like reinforcing fabric, the necessary fiber reinforcements can be wound on the stiffening element and the lower part of the shaft. The fiber reinforcement may be pre-impregnated with resin or it is impregnated with a suitable amount of epoxy resin after the reinforcement has been fitted. FIG. 10*c* shows the third stage of the assembly. The integrated whole formed by the shaft 3, stiffening element 5 and fiber reinforcement 10 is arranged in the recess 4*b* in the side of the blade core 2. Next, at least one strengthening layer 6 is further laminated on both vertical sides of the blade preform by utilizing a suitable plastic material. The strengthening layer may be a reinforcement fabric cut to the shape of the blade or a premanufactured reinforcing laminate. Finally, the preform is arranged in a mold wherein the structure is pressed together and hardened with heat. During the pressing procedure, the blade obtains a desired curvature. A pressed and hardened blade is provided with the desired curvature and thickness. The length of the blade, in turn, can still be worked as desired. Furthermore, it is possible to shape the side profile of the blade within the limits set by the protecting borders 7 at the upper and lower edges of the blade core. The same blade cores can thus be used for manufacturing blades with different side profiles. Furthermore, within certain restrictions, it is also possible to customize the blade according to the personal preferences of a player.

Figure 11:
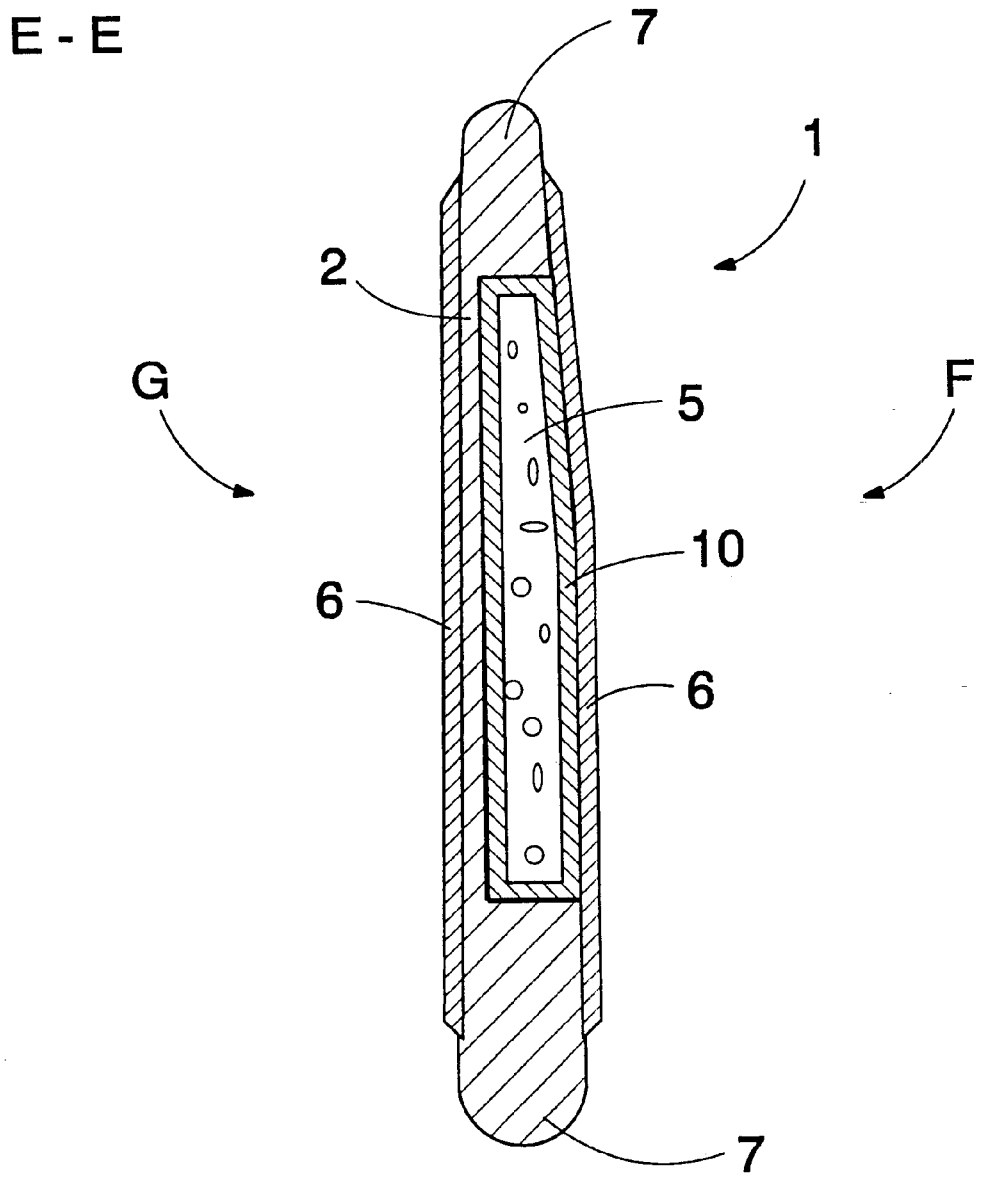
FIG. 11 is a schematic and cross-sectional view of the structure of a blade according to a preferred embodiment of the invention taken along line E—E.

FIG. 11 shows a cross section of a blade manufactured according to FIGS. 10*a* to 10*c* in a highly simplified manner for the sake of clarity, different structural parts being shown in the figure. The sock-like or wound fiber reinforcement 10 forms a seamless cover around the stiffening element 5 and the lower end of the shaft 3. Such a structure enables good torsional rigidity all the way from the shaft to the blade. Furthermore, the blade core and the stiffening element define the cross-sectional shape of the blade. The strengthening layers 6 laminated on the outer surfaces of the blade, in turn, provide the blade with flexural strength and impact resistance needed in slap shots. As can be seen from the figure, the upper and lower edges of the blade are formed such that the fiber reinforcements 6 of the sides do not extend to the edges but at the edges the blade core 2 extends farther than the reinforcements. The blade core 2 manufactured of a tough plastic material thus forms a wear-resistant protecting border 7 at the lower and upper edges of the blade to protect the stiffening elements of the blade against wear. The blade thus wears off slowly in use, retaining its strength characteristics. As shown by the figure, the stiffening element is arranged on the backhand side F of the blade, i.e. the convex side of the blade. The blade core 2 and the strengthening layer 6 laminated on the side thereof are provided on the opposite side of the blade, i.e. the forehand side G. Sticks for left-handers and right-handers are manufactured by utilizing components of the blade manufactured as mirror images of each other.

The drawings and the related description are only intended to illustrate the idea of the invention. In its details, the invention may vary within the scope of the claims. Consequently, a solution is also feasible wherein the blade core is provided with one recess on its both sides, stiffening layers which form the outer surfaces of the side of the blade being laminated in the recess from a fiber-reinforced plastic material. Furthermore, the invention may also be applied to structures in detachable and changeable blades.

What is claimed is:

1. A method of manufacturing a blade of a hockey stick, the method comprising the following steps:

arranging one or more strengthening layers in at least one of a first vertical side and a second vertical side of a core of the blade premanufactured of a wear-resistant material such that at least at a lower edge of the blade, the blade core extends farther than the strengthening layers and forms a wear-resistant border for the edge;

providing at least one of the first and second vertical sides of the blade core with at least two recesses of different size within each other, the at least two recesses constituting an inner recess and an outer recess;

embedding at least one of the strengthening layers in at least one of said two recesses to strengthen the blade, wherein said arranging step comprises arranging an inner strengthening layer made of wood in the inner recess, and said method further comprises laminating an outer strengthening layer made of a fiber-reinforced plastic material in the outer recess.

2. A method as claimed in claim 1, wherein the blade is assembled from premanufactured structural components, whereby the inner strengthening layer is cut off from a wooden plate and the outer strengthening layer is manufactured of reinforceing fibers and a plastic material are attached to the blade core manufactured by injection molding.

3. A method of manufacturing a blade of a hockey stick, the method comprising the following steps:

forming a core of the blade from a wear-resistant material;

providing at least one of the first and second vertical sides of the blade core with at least one flat recess which is parallel with a surface of the at least one side and which is at least approximately similar in length to the blade core;

forming an elongated strengthening element from a second material having a lower density than the material of the blade core, the strengthening element having a substantially similar shape to that of the recess in the side of the blade core;

attaching the strengthening element to a lower end of a shaft of the stick and arranging a fiber reinforcement around the strengthening element and the lower end of the shaft, the strengthening element and the fiber reinforcement forming a blade preform;

attaching the blade preform to the recess in the at least one of the vertical sides of the blade core; and attaching at least one outer strengthening layer substantially shaped as a side profile of the blade to the first side surface and the second side surface of the blade.

4. A method as claimed in claim 3, wherein the second material is plastic.

5. A blade of a hockey stick, the blade comprising:

a blade core of the blade; and one or more strengthening layers arranged in at least one of a first vertical side and a second vertical side of the blade core, wherein the blade core is made of a wear-resistant material and at least at a lower edge of the blade, the blade core extends farther than the strengthening layers, whereby the lower edge of the blade is provided with a wear-resistant border, the at least one side of the blade core has two recesses within each other, the two recesses constituting an inner recess and an outer recess, an inner strengthening layer is arranged in the inner recess and an outer strengthening layer is arranged in the outer recess, and the outer recess has a greater surface area than the inner recess.

6. A blade as claimed in claim 5, wherein the inner strengthening layer is made of wood and the outer strengthening layer is made of a fiber-reinforced plastic material.

7. A blade as claimed in claim 5, wherein the wear-resistant material is plastic.

8. A blade of a hockey stick, the blade comprising:

a blade core of the blade; and one or more strengthening layers arranged in a first and a second vertical side of the blade core, wherein the blade core is made of a wear-resistant first material and at least at a lower edge of the blade, the blade core extends farther than the strengthening layers, whereby the lower edge of the blade is provided with a wear-resistant border, and wherein at least one side of the blade core is provided with a flat recess parallel with a surface of the side and at least approximately similar in length to the blade core, the blade further comprising:

a strengthening element arranged in the recess of the blade core, the strengthening element being substantially of a similar shape to that of a profile of the recess in the blade core and made of a second material having a lower density than that of the blade core;

a cover layer provided on an outer surface of the strengthening element, said cover layer being made of reinforcing fibers and a third material; and at least one outer strengthening layer attached to the first and the second sides of the blade core and having a substantially similar profile to that of the blade.

9. A blade as claimed in claim 8, wherein the cover layer extends to a lower end of a shaft of the stick, thus forming a uniform reinforcement between the shaft and the blade.

10. A blade as claimed in claim 8, wherein the first, second and third materials are plastic materials.

* * * * *

UNITED STATES PATENT AND TRADEMARK OFFICE

CERTIFICATE OF CORRECTION

PATENT NO. : 6,626,775 B2
DATED : September 30, 2003
INVENTOR(S) : Antti-Jussi Tiitola It is certified that error appears in the above-identified patent and that said Letters Patent is hereby corrected as shown below:

Title page,
Item [30], Foreign Application Priority Data, insert -- Priority is claimed from December 2, 1999 and November 14, 2000, based on Finnish Application Nos. 19992596 and 20002490, respectively. --

Signed and Sealed this

Twenty-second Day of June, 2004

JON W. DUDAS
*Acting Director of the United States Patent and Trademark Office*